US008672615B2

(12) United States Patent
Rückert et al.

(10) Patent No.: US 8,672,615 B2
(45) Date of Patent: Mar. 18, 2014

(54) DIAGONAL FAN

(75) Inventors: Christian Rückert, Lauda-Königshofen (DE); Jürgen Schöne, Bad Mergentheim (DE); Jörg Günther, Dörzbach (DE); Oliver Haaf, Obersulm (DE); Erich Hofmann, Mulfingen-Ailringen (DE)

(73) Assignee: EBM-PAPST Mulfingen GmbH & Co. KG, Mulfingen (DE)

( * ) Notice: Subject to any disclaimer, the term of this patent is extended or adjusted under 35 U.S.C. 154(b) by 429 days.

(21) Appl. No.: 13/124,765

(22) PCT Filed: Sep. 29, 2009

(86) PCT No.: PCT/EP2009/062627

§ 371 (c)(1),
(2), (4) Date: Apr. 18, 2011

(87) PCT Pub. No.: WO2010/052074

PCT Pub. Date: May 14, 2010

(65) Prior Publication Data

US 2011/0200438 A1 Aug. 18, 2011

(30) Foreign Application Priority Data

Nov. 7, 2008 (DE) ..... 10 2008 056 459

(51) Int. Cl.
*F04D 29/60* (2006.01)

(52) U.S. Cl.
USPC ..... 415/121.2; 415/213.1; 415/214.1; 416/244 R

(58) Field of Classification Search
USPC ..... 415/213.1, 214.1, 121.2; 416/244 R, 416/246, 247 R, 204 R
See application file for complete search history.

(56) References Cited

U.S. PATENT DOCUMENTS

| | | | | | |
|---|---|---|---|---|---|
| 4,130,770 | A | * | 12/1978 | Wrobel | 310/67 R |
| 4,909,711 | A | * | 3/1990 | Burgbacher et al. | 417/354 |
| 5,184,938 | A | * | 2/1993 | Harmsen | 416/223 R |
| 5,810,554 | A | * | 9/1998 | Yokozawa et al. | 415/176 |

(Continued)

FOREIGN PATENT DOCUMENTS

| | | |
|---|---|---|
| DE | 9100671 U1 | 7/1991 |
| DE | 20316909 U1 | 2/2004 |
| WO | WO 2006/042635 | 4/2006 |

OTHER PUBLICATIONS

International Search Report on Patentability—May 10, 2011.

*Primary Examiner* — Edward Look
*Assistant Examiner* — Juan G Flores
(74) *Attorney, Agent, or Firm* — Brinks Gilson & Lione

(57) ABSTRACT

A diagonal fan has a diagonal fan impeller (1) which is fastened to a rotor (2) of an external rotor motor (3) and which is arranged between a front plate (5), which has an in particular central inflow opening (6), and a motor bracket (4). The motor bracket (4) is connected to the front plate (5) via a plurality of peripherally arranged spacers (21). Here, the front plate (5) and the motor bracket (4) are formed as plastic or metal injection molded parts. The spacers (21) are formed, as plastic or metal injection parts, in one piece with the front plate (5) or with the motor bracket (4).

15 Claims, 8 Drawing Sheets

(56) References Cited

U.S. PATENT DOCUMENTS 6,942,471 B2 * 9/2005 Weisser ..... 417/423.1
8,016,556 B2 9/2011 Teshima et al.
2003/0202879 A1 10/2003 Huang et al.
2008/0223558 A1 * 9/2008 Otsuki et al. ..... 165/121

* cited by examiner

DIAGONAL FAN

CROSS REFERENCE TO RELATED APPLICATION

This application claims priority to German Patent Application No. 10 2008 056 459.1, filed Nov. 7, 2008, and International Patent Application No. PCT/EP2009/062627, filed Sep. 29, 2009.

TECHNICAL FIELD AND BACKGROUND

The present invention relates to a diagonal fan, comprising a diagonal fan impeller that is fixed to a rotor of an external rotor motor and which is arranged between a front plate, in particular with a central inflow opening, and a motor bracket, wherein the motor bracket is connected to the front plate by means of a plurality of peripherally arranged spacers.

Compact fans that have such a configuration are known, for example, from the document DE 9017873 U1.

SUMMARY OF THE INVENTION

Starting from such a compact fan, the present invention is based on the problem of implementing an easily assembled and compact design for diagonal fans, which additionally guarantees improved flow properties.

According to the invention, this is achieved in a construction of a diagonal fan as described above in that the front plate and the motor bracket are formed as plastic and/or metal injection-molded parts and the spacers are formed integrally with the front plate or the motor bracket. It is advantageous in this regard if the spacers consist of flat webs having a cross-sectional profile whose height is greater than its thickness and wherein the webs can preferably be oriented in such a manner that they run at an incline in the outflow direction of the flow medium exiting from the diagonal fan impeller.

According to the invention therefore, a design is created that is easily manufactured, since the housing formed from the front plate and the motor bracket consists of only two individual parts. In addition, all essential functions can be integrated into the housing. The preferred configuration of the spacers guarantees that low flow turbulence appears at the outlet of the flow medium, so that no disruptive noises can arise.

Advantageous configurations of the invention are presented in the description below. The invention will be discussed in detail based on the exemplary embodiments represented in the appended drawings.

DETAILED DESCRIPTION OF THE DRAWINGS

In the various figures of the drawings, identical parts are always labeled with the same reference numbers.

Figure 1:
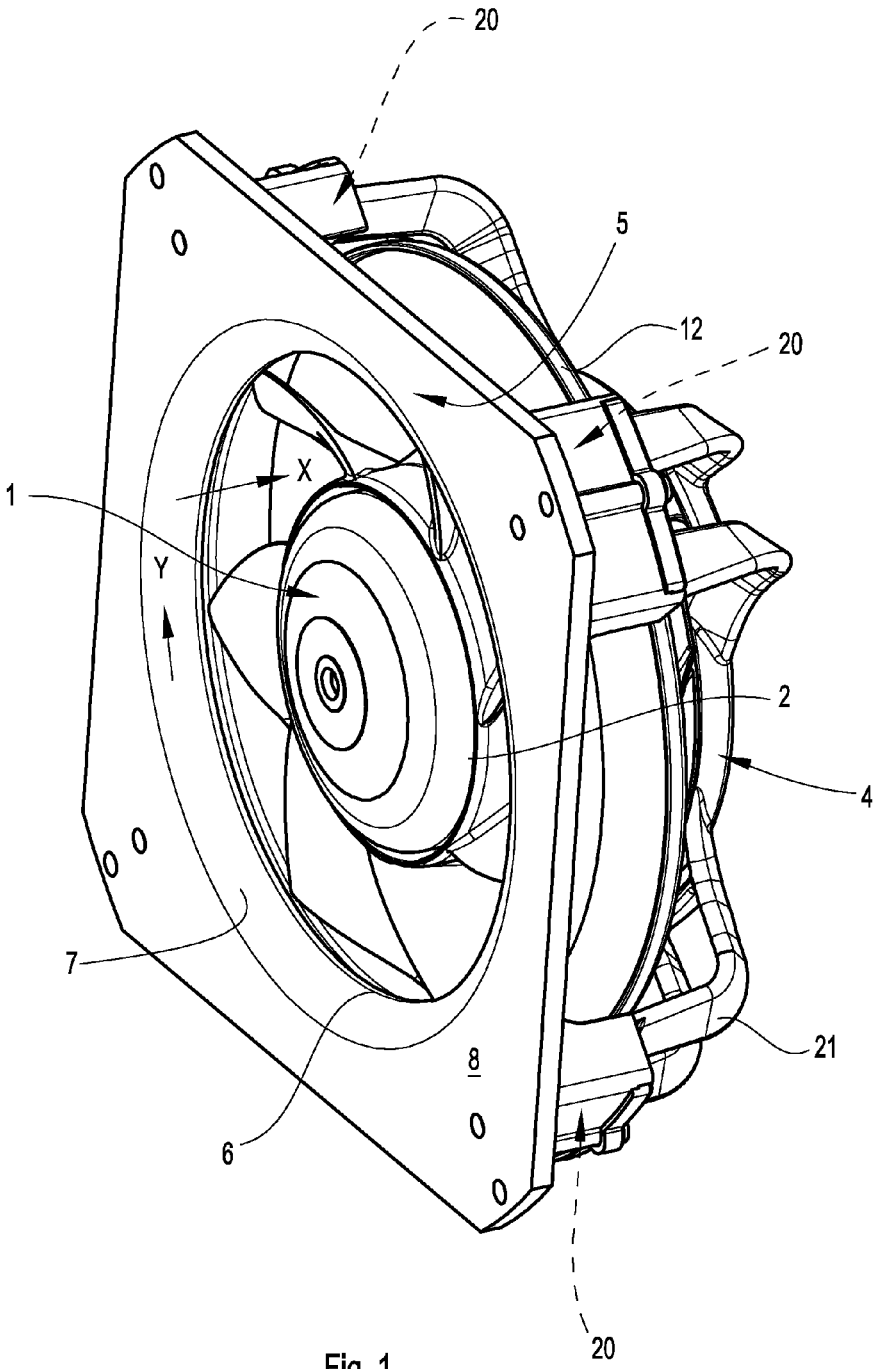
FIG. 1 shows a perspective view of the front side of a diagonal fan according to the invention in a first embodiment.
Figure 2:
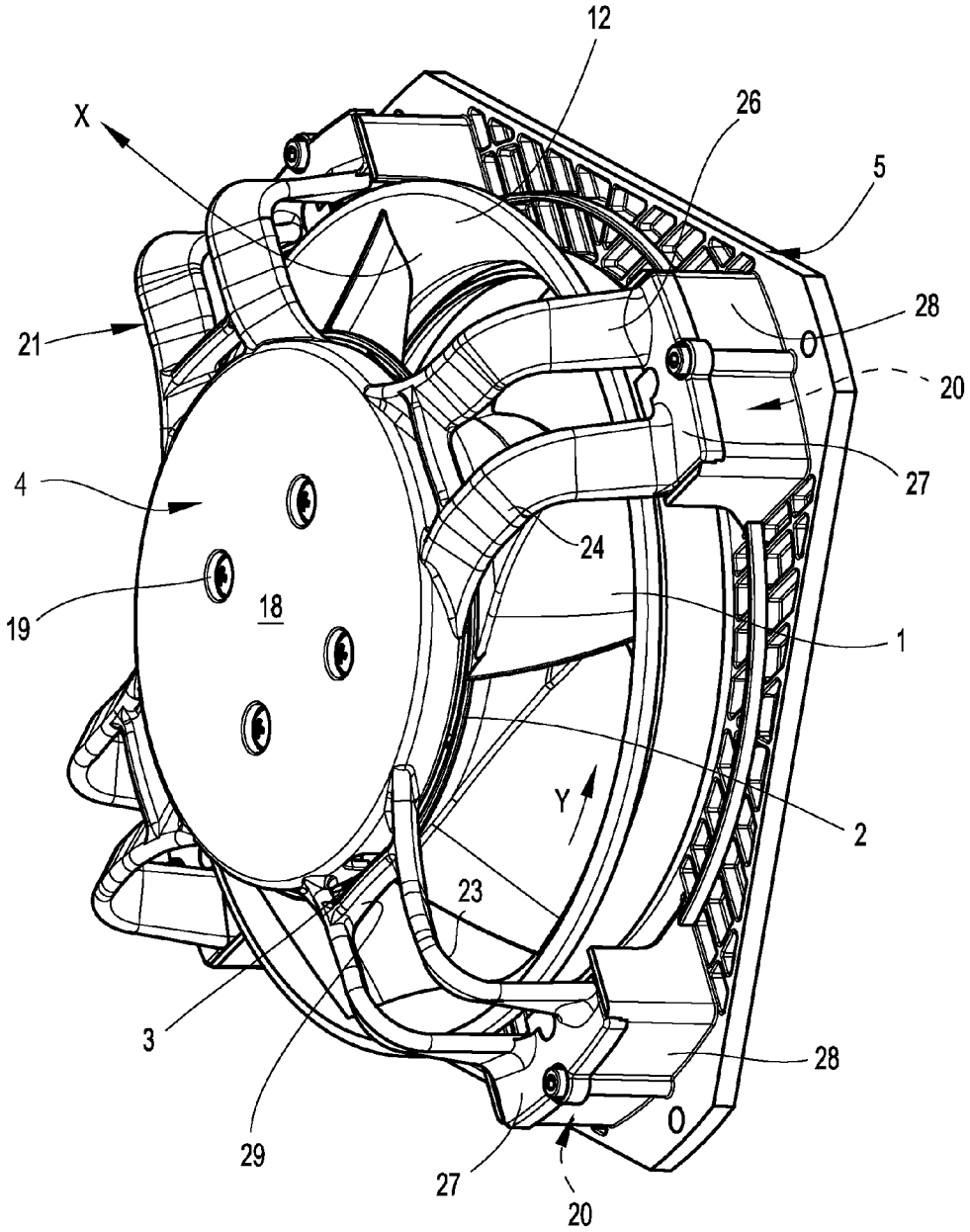
FIG. 2 shows a perspective view of the rear side of a diagonal fan according to the invention in FIG. 1.

As shown first in FIGS. 1 and 2, a diagonal fan according to the invention consists of a diagonal fan impeller 1 that is fixed to a rotor 2 of an external rotor motor 3. The external rotor motor 3 is arranged between a motor bracket 4 and a front plate 5. The front plate 5 has a central inflow opening 6, through the opening center of which the axis of rotation of the external rotor motor 3 runs. A peripheral web 7 pointing in a direction towards the external rotor motor 3 is molded onto the circumference of the inflow opening 6, the transition of a front surface 8 of the front plate 5 into the peripheral web 7 being rounded in such a manner that a flow-favoring wall contour is formed, by forming a type of inflow nozzle. The diagonal fan impeller 1 consists of a hub 9 (see FIG. 4) on which fan blades 11 are arranged circumferentially. The fan blades 11 are shaped in the usual manner, with an axial-radial airflow to the outside through the inflow opening 6 in the direction of the arrow X, for a rotation in the direction of the arrow Y, resulting from the diagonal fan impeller 1 due to the vane shape illustrated in FIGS. 1-4.

Figure 3:
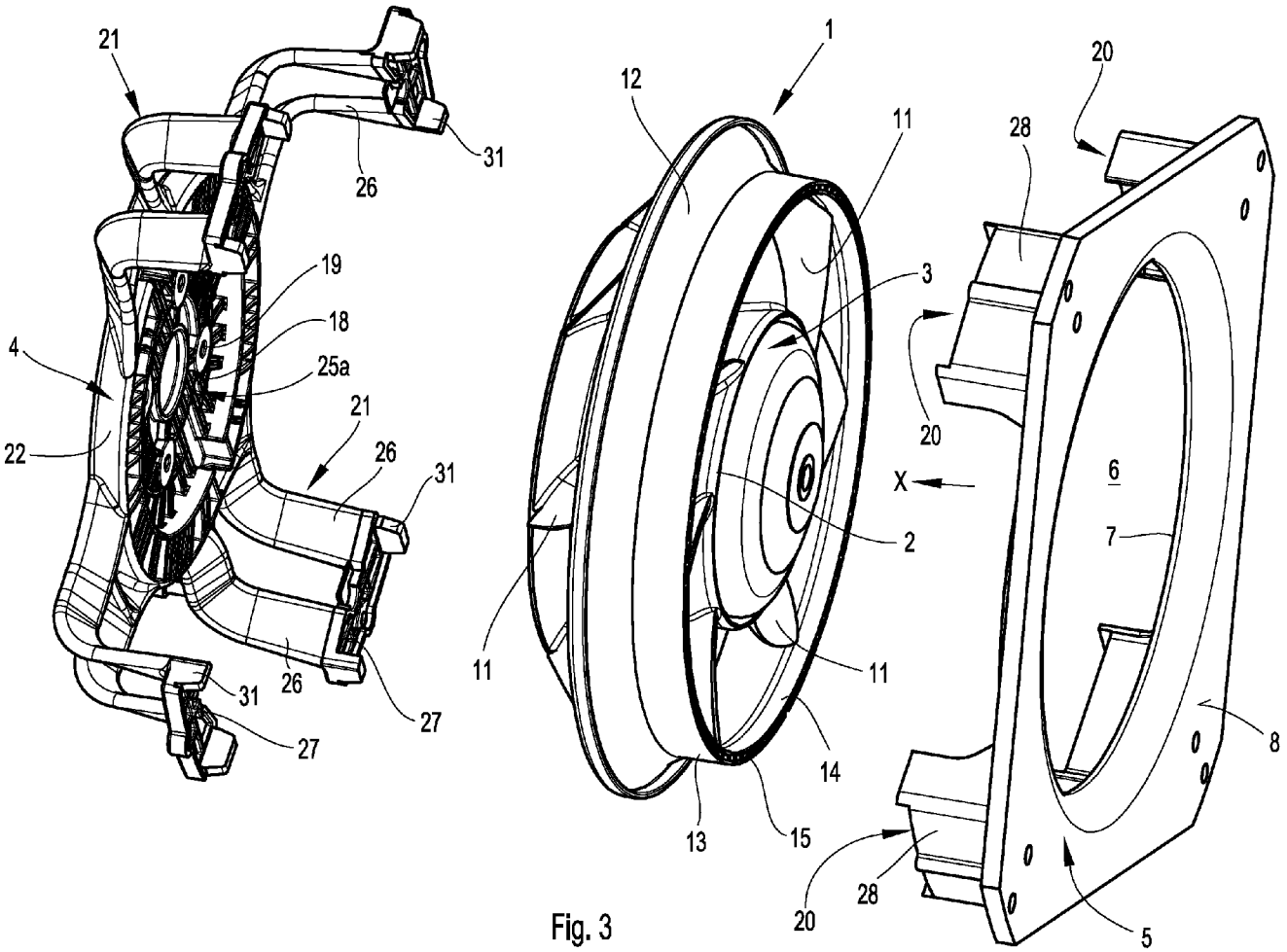
FIG. 3 shows an exploded view of the diagonal fan according to the invention corresponding to the view of FIG. 1.
Figure 4:
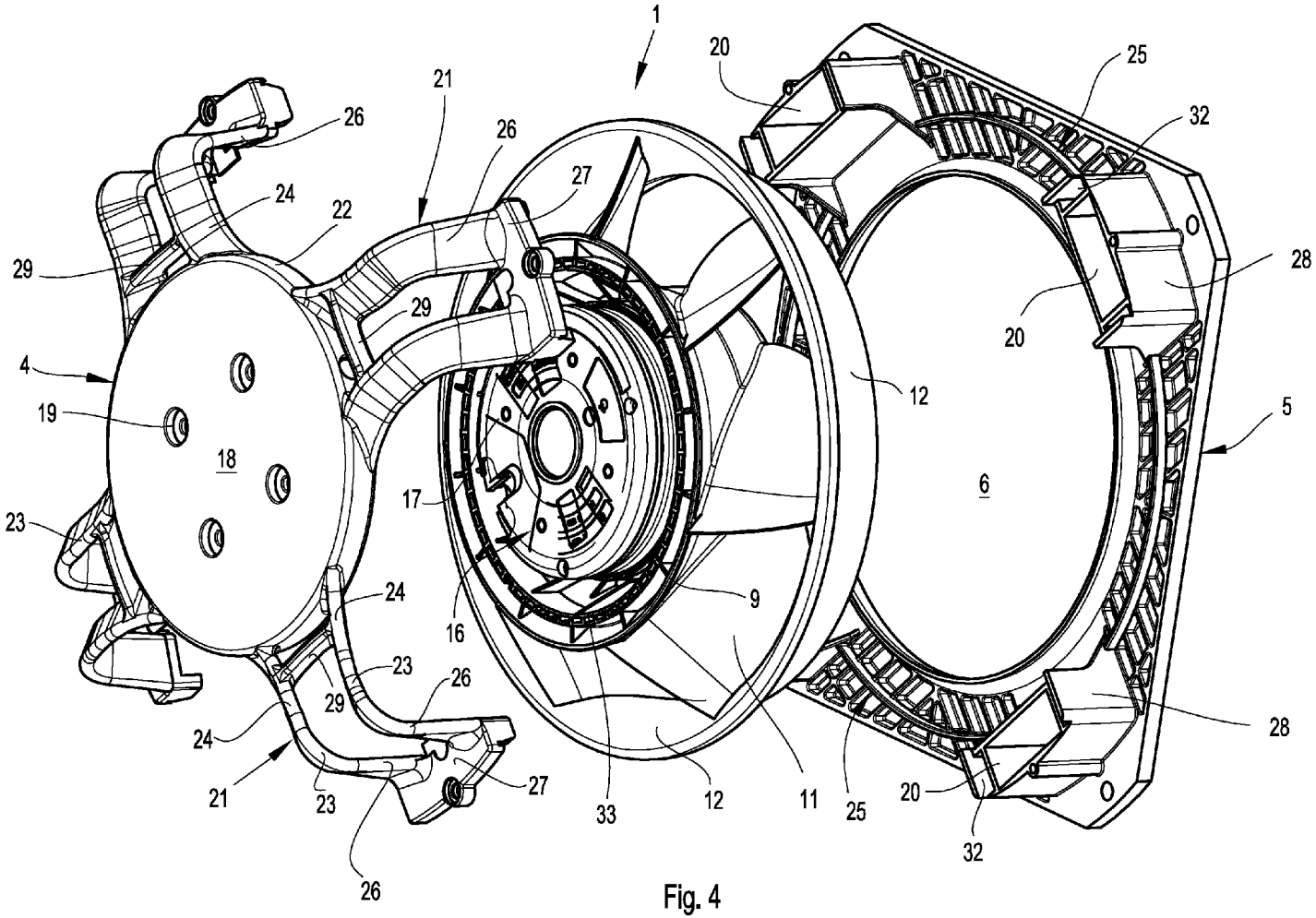
FIG. 4 shows an exploded view of a diagonal fan according to the invention corresponding to the view of FIG. 2.
Figure 5:
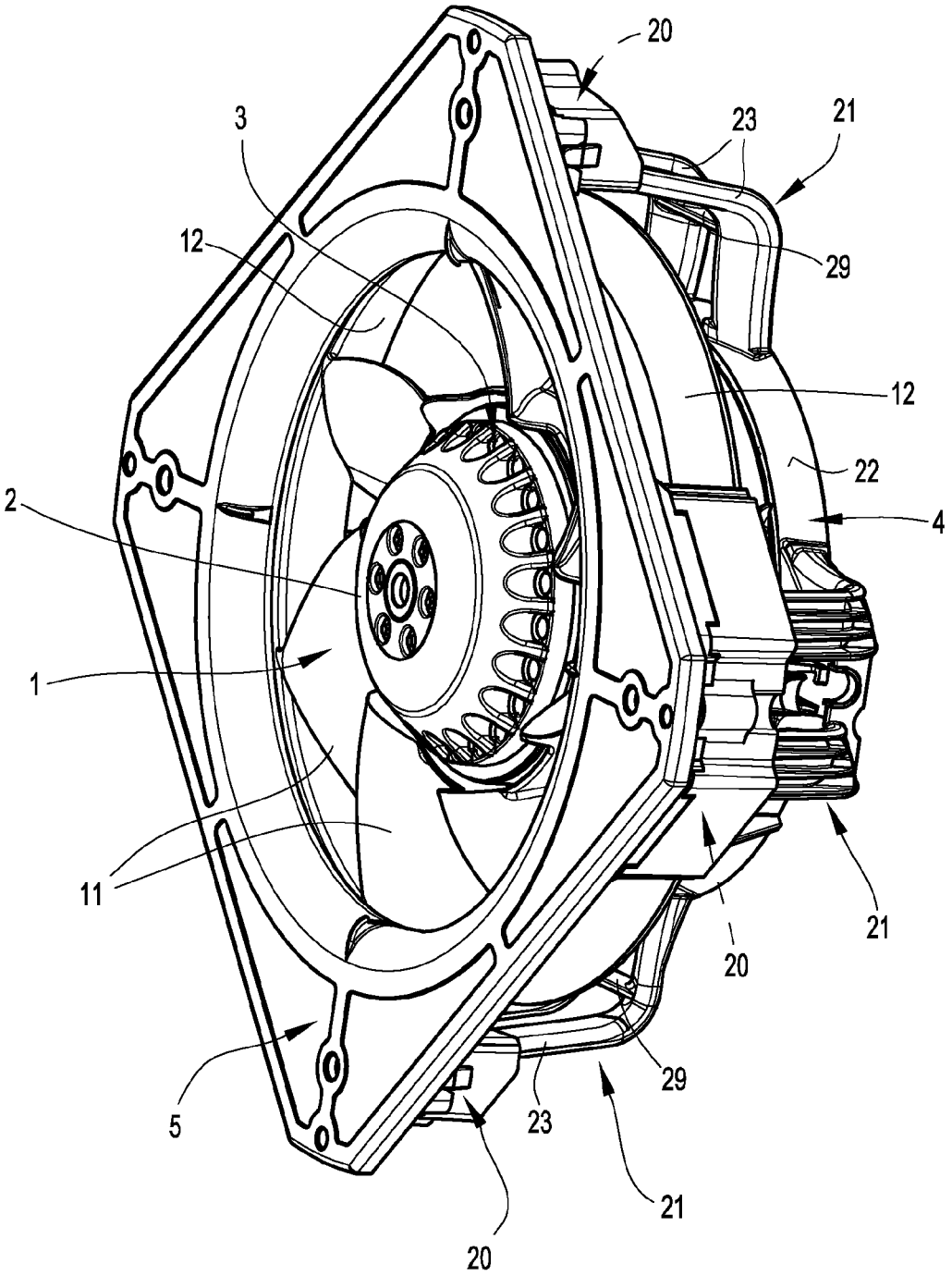
FIG. 5 shows a view corresponding to FIG. 1 of a second, alternative embodiment of the diagonal fan according to the invention.
Figure 6:
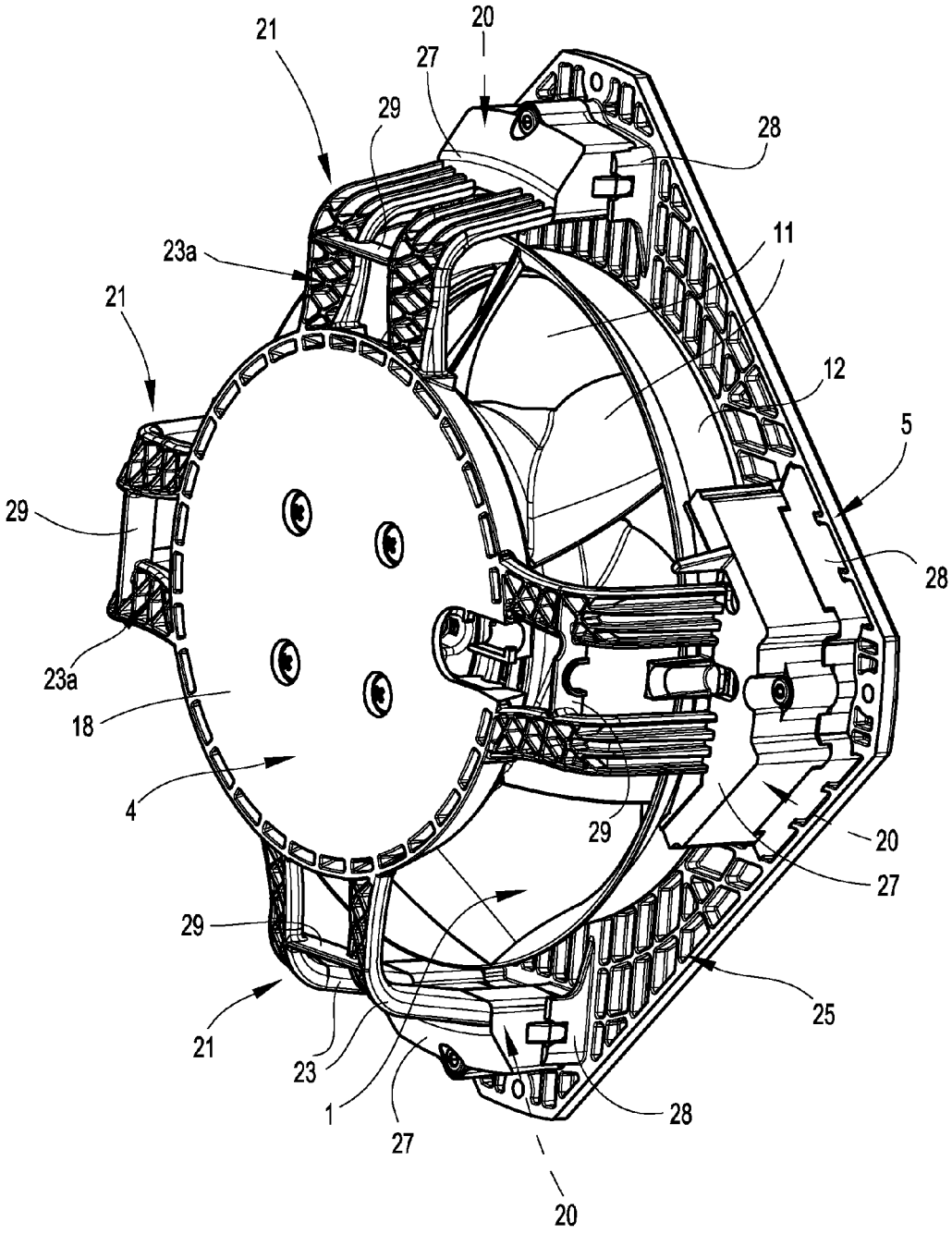
FIG. 6 shows the embodiment according to FIG. 5 in a view analogous to FIG. 2.
Figure 7:
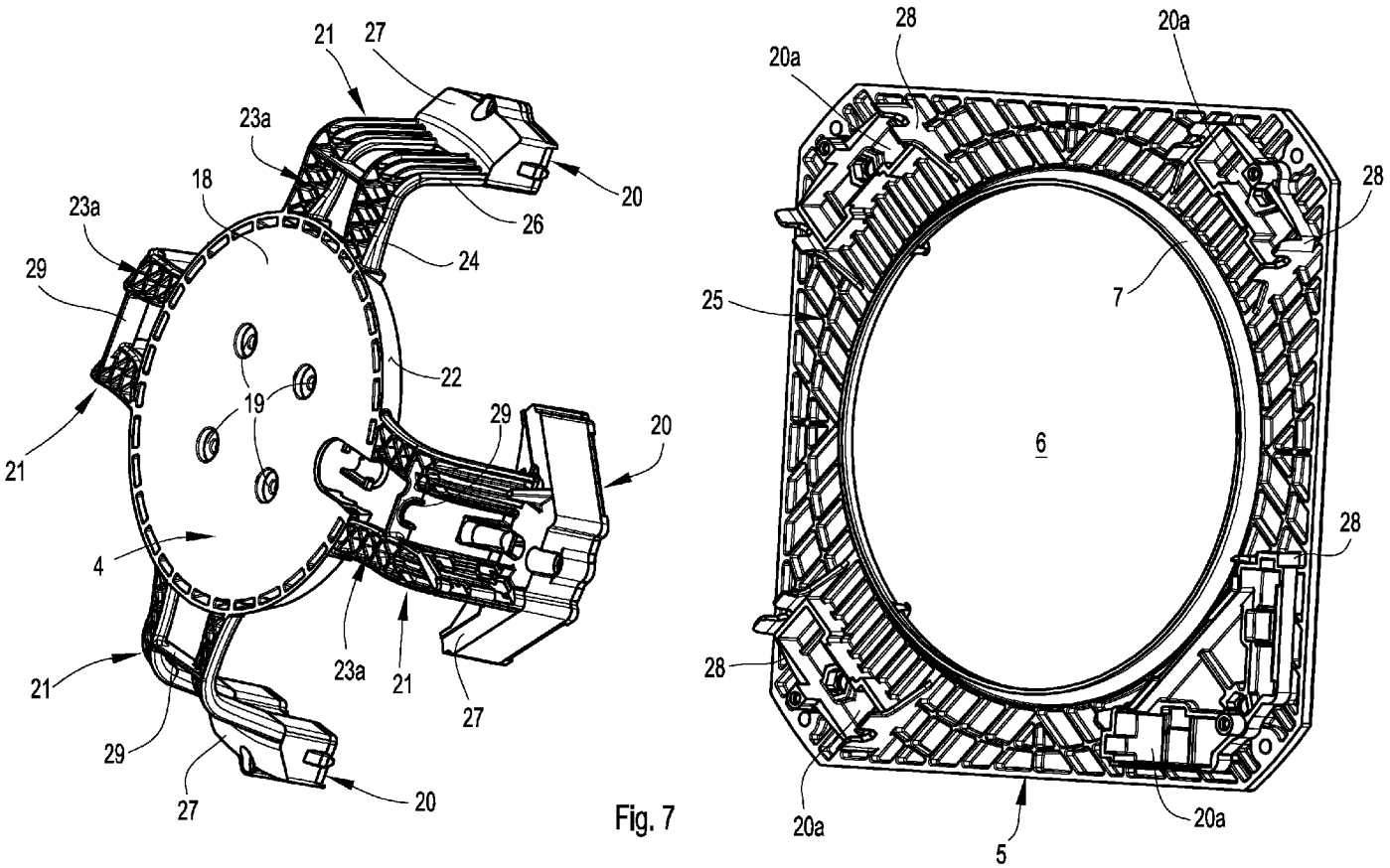
FIG. 7 shows an exploded perspective view analogous to FIG. 4 of the diagonal fan according to FIGS. 5 and 6, but without motor and fan impeller.
Figure 8:
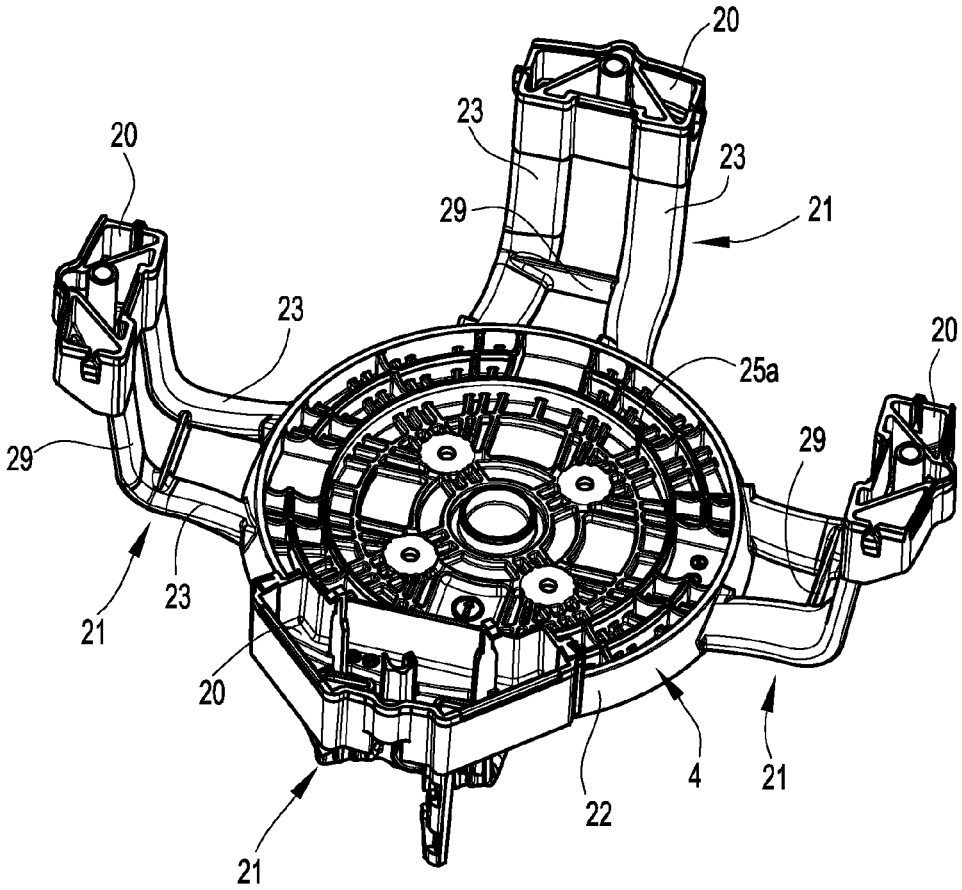
FIG. 8 shows a separate perspective view of the motor bracket according to FIG. 7 on its interior side (corresponding roughly to FIG. 3).

The fan blades 11 are surrounded by an air guidance shell 12, which is preferably connected to the fan blades 11 at their ends, so that it rotates along with the fan blades 11. Reference is made in this regard to FIGS. 3 and 4 in particular. The hub 9 and the air guidance shell 12 have the shape of a truncated cone, the corresponding radii increasing from the inflow side (suction side) to the blow-out side. This has the effect that the flow obtains a radial flow component in addition to its axial flow component, whereby an increase of pressure is brought about. On its inflow side, the diagonal fan impeller 1 has an annular collar 13 on the air guidance shell 12, surrounding the inflow opening of the diagonal fan impeller 1. The outside diameter of the annular collar 13 is dimensioned in such a manner that it projects contact-free with a small clearance in the assembled state into the inflow opening enclosed by the circumferential web 7. In its side face 14, the annular collar 13 has pockets 15 (FIG. 3), in which balancing weights can be mounted. On its stator 16, the external rotor motor 3 has a stator flange 17 that is used for fixing the motor bracket 4. For this purpose, the motor bracket 4 has a circular holding plate 18, whose outside diameter is matched to the outside diameter of the circular hub 9. The stator flange 17 is screwed to the holding plate 18 by means of screws through holes 19 therein.

The motor bracket 4 and the front plate 5 are connected via spacers 21. In the present case, four spacers 21 are molded on the periphery of the holding plate 18 at its circumferential edge 22.

The spacers 21 consist of flat webs 23 with a cross-sectional profile whose height or width is larger than its thickness. The webs 23 consist of a first web leg 24 extending roughly radially outwards from the peripheral wall 22 and a second web leg 26 running via an approximately 90° bend in a second, roughly axial direction, i.e. parallel to the motor axis. The webs 23 shaped in this manner enclose the diagonal fan impeller 1. The webs 23 are oriented with the flat profile of their web legs 24, 26 in such a manner that they run at an incline in the blow-out direction of the air stream exiting from the diagonal fan impeller 1. This reduces turbulence that can cause flow noise. At their free ends, the webs 23 have a plate-shaped connecting element 27 with which they are mounted on the front plate 5 on the backside of the latter, preferably via a detachable connection, e.g., by means of screws. The front plate 5 has bearing projections 28 for this purpose.

Hollow chambers 20 can be formed in the respective connection area of the connecting elements 27 of the spacers 21 to the bearing projections 28. These hollow chambers 20 can be used to house electronic components, e.g. capacitors as components of motor electronics. In the first embodiment according to FIGS. 1-4, it is mainly the bearing projections 28 which are formed as hollow chambers 20 (see FIG. 4 in particular). The plate-shaped connecting elements 27 expediently serve simultaneously as covers for the hollow chamber-like bearing projections 28.

As shown in the illustrated embodiments, each spacer 21 preferably consists of two webs 23 that run parallel to one another and are connected to one another at their free ends via the connecting element 27. The webs 23 can be connected to one another by at least one bridge web 29 for stiffening in the area between the connections of the web 23 to the holding plate 18 and the connecting element 27.

According to FIGS. 1-4, the connecting elements 27 have guide tabs 31 molded onto their shorter transverse edges that fit into guide pockets 32 of the bearing projections 28, into which pockets they are inserted when the webs 23 are mounted. As can be recognized from FIG. 4, the hub 9 has pockets 33, into which balancing weights can be inserted, in a wall of the hub body on its end face turned towards the motor bracket 4. On its rear side, the front plate 5 is provided with a rib structure 25, whereby both a saving of materials and a stiffening of the front plate 5 are achieved. As shown in FIG. 3, the holding plate 18 also has a rib structure 25*a* on its side facing the external rotor motor 3, so that the holding plate is not constructed as a thick-walled heavy part.

It is provided according to the invention that the front plate 5 and the motor bracket 4 are constructed as plastic and/or metal injection-molded parts and the spacers 21 are produced as plastic and/or metal injection-molded parts in one piece with the front plate 5 or the motor bracket 4. This configuration according to the invention yields a fan housing consisting of only two injection-molded parts, which implies an easily assembled and compact construction.

In the alternative embodiment of the diagonal fan according to the invention as shown in FIGS. 5-8, identical parts are labeled with reference numbers corresponding to FIGS. 1-4. The different aspect of this embodiment is that the hollow chambers 20 are mainly formed in the area of the connecting elements 27 of the spacers 21 (see FIG. 8). According to FIG. 7, however, proportionate chambers 20*a* can also be formed on the side of the bearing projections 28 of the front plate 5. The spacers 21 or their webs 23 according to FIGS. 6 and 7 further comprise ribs 23*a* for saving material and weight as well as for stiffening.

The invention is not limited to the illustrated embodiment, but rather includes all means functioning identically within the meaning of the invention. The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A diagonal fan, comprising a diagonal fan impeller fixed on a rotor of an external rotor motor and arranged between a front plate with a central inflow opening and a motor bracket, a plurality of circumferentially arranged spacers connecting the motor bracket to the front plate, the front plate and the motor bracket being injection molded parts, and the spacers being integrally formed with one of the front plate and the motor bracket as an injection molded part, further comprising that the diagonal fan impeller has an outflow direction of flow medium, that the spacers consist of flat webs having a cross-sectional profile with a width and a thickness, the thickness being smaller than the width, that the webs are oriented in such a manner that they run at an incline in the outflow direction, that the spacers and the motor bracket are molded in one piece, that the spacers have free ends that are mounted on the front plate via a detachable connection, and that each web includes a first web leg extending roughly radially outwards from a circumferential edge of the motor bracket and a second web leg running axially with respect to the motor bracket, wherein the first web leg transitions via an approximately 90° bend into the second web leg.

2. The diagonal fan according to claim 1, further comprising that the spacers are each formed from two parallel webs.

3. The diagonal fan according to claim 1, further comprising that the webs of the spacers have free ends with a plate-like connecting element.

4. The diagonal fan according to claim 1, further comprising that the front plate has bearing projections facing the spacers and adapted for attaching the webs.

5. The diagonal fan according to claim 4, further comprising hollow chambers in the area of the bearing projections.

6. The diagonal fan according to claim 1, further comprising that the front plate has a rib structure.

7. The diagonal fan according to claim 1, further comprising that the motor bracket forms a circular holding plate with a peripheral edge on which the spacers are molded.

8. The diagonal fan according to claim 1, the external rotor motor further comprising a stator configured to be mounted on the motor bracket via screws.

9. The diagonal fan according to claim 1, further comprising that the diagonal fan impeller has a hub enclosing the rotor of the external rotor motor (3), a plurality of fan blades being arranged on the periphery of the hub, and the fan blades being enclosed by an air guidance shell.

10. The diagonal fan according to claim 9, further comprising that the hub and the air guidance shell substantially form two concentric truncated cones.

11. The diagonal fan according to claim 10, further comprising that the air guidance shell (12) is rigidly connected to the fan blades.

12. A diagonal fan, comprising a diagonal fan impeller fixed on a rotor of an external rotor motor and arranged between a front plate with a central inflow opening and a motor bracket, a plurality of circumferentially arranged spacers connecting the motor bracket to the front plate, the front plate and the motor bracket being injection molded parts, and the spacers being integrally formed with one of the front plate and the motor bracket as an injection molded part, the spacers are each formed from two parallel webs further comprising that the spacers are each formed from two parallel webs and that the two parallel webs are connected to one another by at least one bridge web.

13. The diagonal fan according to claim 12, further comprising that the diagonal fan impeller has an outflow direction of flow medium, that the spacers consist of flat webs having a cross-sectional profile with a width and a thickness, the thickness being smaller than the width, and that the webs are oriented in such a manner that they run at an incline in the outflow direction.

14. The diagonal fan according to claim 13, further comprising that the spacers and the motor bracket are molded in one piece and that the spacers have free ends that are mounted on the front plate via a detachable connection.

15. The diagonal fan according to claim 14, further comprising that each web includes a first web leg extending roughly radially outwards from a circumferential edge of the motor bracket and a second web leg running axially with respect to the motor bracket, wherein the first web leg transitions via an approximately 90° bend into the second web leg.

* * * * *